United States Patent [19]

Brinker

[11] 4,037,276

[45] July 26, 1977

[54] MULTIFUNCTIONAL TOOL FOR RESCUE WORK

[76] Inventor: Reiner G. Brinker, 5424 Camille Drive, Mechanicsville, Va. 23111

[21] Appl. No.: 687,253

[22] Filed: May 17, 1976

[51] Int. Cl.[2] ..... B26B 11/00

[52] U.S. Cl. ..... 7/6; 30/254

[58] Field of Search ..... 30/254, 257, 259, 201; 7/1 H, 5.6, 6

[56] References Cited

U.S. PATENT DOCUMENTS

| | | | |
|---|---|---|---|
| 389,553 | 9/1888 | Diefendorf | 7/6 |
| 422,670 | 3/1890 | Wallace | 7/6 |
| 591,720 | 10/1897 | Armstrong | 7/5.6 X |
| 667,914 | 2/1901 | Klever | 7/6 |
| 3,055,108 | 9/1962 | March | 30/257 |
| 3,196,540 | 7/1965 | Porzky | 30/254 |

*Primary Examiner*—Al Lawrence Smith
*Assistant Examiner*—J. C. Peters
*Attorney, Agent, or Firm*—Norman B. Rainer

[57] ABSTRACT

A multipurpose combination tool based upon hand-operated shears is provided having special utility in rescue work. The shears comprise blade portions, a bevel edged recess for severing cables, an angled juncture associated with said blade portions to facilitate the cutting of thick sheet materials, a protective stub at the terminus of said blade portions, and other features.

8 Claims, 3 Drawing Figures

MULTIFUNCTIONAL TOOL FOR RESCUE WORK

BACKGROUND OF THE INVENTION

This invention relates to a combination tool, and more particularly to a multi-purpose tool based upon the principle of hand shears, and particularly useful in rescue operations.

Multi-purpose combination tools based upon the principle of hand-held shears have been disclosed in U.S. Pat. Nos. 553,579 to Frye, 1,666,968 to James, 1,356,119 to Bassisty, 2,778,254 to Carapellotti, 2,434,550 to Daniel and 2,131,395 to Voss. Such implements have generally been designed for specific areas of application such as kitchen tasks, fisherman's tasks or specialized manufacturing operations.

In the realm of rescue work, such as practiced in many cities and rural areas, the rescue worker is often called upon to rapidly respond to an emergency situation involving actual or potential personal injury or property damage. Because of the urgent and varied nature of each assignment, and the adverse or hazardous working conditions generally encountered, it is not feasible for the rescue worker to carry a large assortment of cumbersome tools. Nevertheless, certain tasks, both common and specialized, must frequently be performed in the course of rescue missions, and the requisite tools may be indispensible. A particularly prevalent task encountered is a cutting operation, as may be carried out on battery cables, clothing, auto seat belts or other items of common occurrence.

It is accordingly an object of the present invention to provide a compact hand tool which can perform a number of useful functions. It is another object to provide rugged compact hand shears specially adapted to perform a number of functions found useful in rescue operations. These and other objects and advantages will become apparent hereinafter.

SUMMARY OF THE INVENTION

The objects of the present invention are accomplished in general by providing shears comprising a pair of elongated integral members, each comprising a handle portion, shank portion and substantially straight blade portion, said members being pivotably connected in opposed relationship by a threaded bolt in a manner such that said blade portions can be brought into sliding, overlapping contact. One of said straight blade portions is provided with a beveled cutting edge, and tapers to a pointed tip. The opposing blade portion extends beyond said pointed tip and terminates with a stub extending vertically from the plane of the shears and in the direction of the opposing blade portion. Located between the pivot bolt and said pointed tip is an arcuate, bevel edged recess adapted to engage with the opposing blade portion in a cutting relationship. The forward extreme of said arcuate recess meets with the beveled cutting edge of said straight blade portion at a juncture having an angle of less than 100°. The shank portions of said integral members contain cooperatively opposed notches disposed such that, when the handle portions are brought together, said notches align to form a square-apertured jaw. At least one of the handle portions possesses a flat outer striking surface. The shears may be provided with a wedge-shaped protrusion extending as a continuation of the rear edge of one of the handle portions, and likewise a pointed protrusion. In a preferred embodiment, a recessed storage compartment is provided on the inside of the handle portions and accomodates a pivotably attached deployable elongated tool.

DETAILED DESCRIPTION OF THE INVENTION

Figure 1:
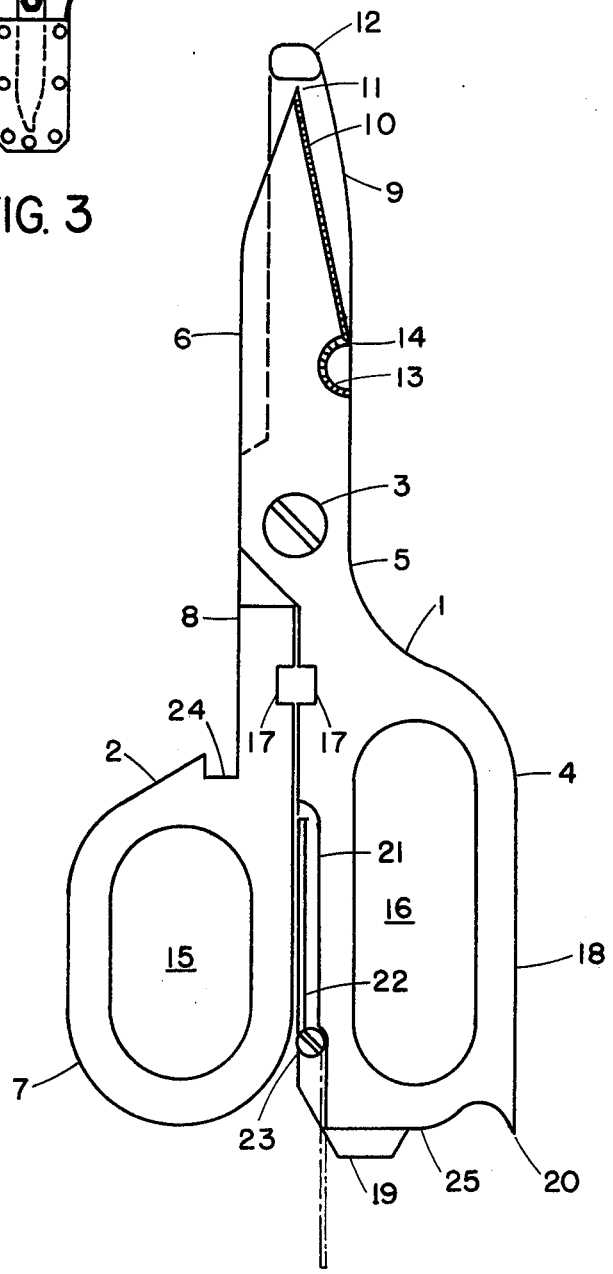
FIG. 1 is a front elevational view of the combination tool of the present invention.

Referring to FIG. 1, the combination tool of this invention is seen to be a specially designed shears comprising integral elongated members 1 and 2 pivotably connected by means of a threaded bolt 3 at a site generally mid-length of said elongated members. Elongated member 1 is comprised of handle portion 4, shank portion 5 and blade portion 6. Elongated member 2 is comprised of handle portion 7, shank portion 8 and blade portion 9. Handle portion 4 contains the finger eye 16 adapted to accomodate the fingers of the user. Handle portion 7 contains the thumb eye 15 adapted to accomodate the thumb of the user.

Blade portion 6 is provided with a beveled cutting edge 10, and tapers to a pointed tip 11. Blade portion 9 contains at its terminus a stub 12 which is an integral extension of said blade portion, and extends in the direction of elongated member 1. An arcuate bevel edged recess 13 is located between the bolt 3 and tip 11 of blade portion 6. The forward extreme of said recess 13 meets beveled cutting edge 10, forming therewith the angled junction 14.

Cooperatively opposed notches 17 are disposed in shank portions 5 and 8 in a manner such that when the handle portions are brought together, said notches 17 meet to form a square-apertured jaw.

Handle portion 4 contains a flat outer edge 18, and a rear edge 25 containing the wedge-shaped protrusion 19 extending therefrom as an integral continuation thereof, and likewise a pointed extension 20 which constitutes a continuation of the flat outer edge 18.

As shown in the embodiment of FIG. 1, the inside edge of handle portion 4 is provided with a recessed compartment 21 which extends to the rear edge of said handle portion and houses the deployable key 22 mounted on pivot screw 23. The key 22 is illustrated in its deployed condition in FIG. 1 by the dotted lines extending from pivot screw 23. An indentation 24 is shown in the front edge of handle portion 7.

The overall length of the shears of this invention, as measured from outer edge 25 of handle portion 4, to the outer edge of the stub 12, may range between about 6 inches and 10 inches. Shears smaller than this range will not possess adequate weight or strength to accomplish the various intended functions. Shears larger than 10 inches will become unwieldy and cumbersome, thus defeating the basic objective of the invention. The shears are preferably fabricated of a corrosion-resistant steel having high strength and hardness, and provided with a non-reflective surface finish. The thickness of the metal stock from which the integral members 1 and 2 are fabricated is preferably about 0.25 inch.

The bolt 3 is preferably centered at a location closer to the stub end of the shears than the handle end, and more preferably is located at a site between 50 and 60 percent of the distance between the outer edge 25 of handle portion 4, and the outer edge of the stub 12. The bolt 3 may engage either with a threaded passageway in the opposing integral member 2, or may engage with a threaded nut 31 positioned on the opposite side of the opposing integral member. By tightening the bolt, the two integral members of the shears are brought into closer contact, and the nut prevents the bolt from loosening.

In operation, the function of the arcuate recess 13 is to enable the rescue worker to sever cables, lines, ropes, tubes, rods, small tree branches, and other comparable long, narrow structures. By virtue of the design and position of the recess, and its particular engagement with the blade portion of the opposing integral member, said cables and the like can be securely gripped, and sufficient leverage can be applied to cause severance.

The angled junction 14, formed by the meeting of arcuate recess 13 with beveled edge 10 provides the shears with the capability of initiating a cutting action in relatively thick sheet structures which cannot be cut with ordinary scissors or shears. The cutting action is initiated essentially as a puncturing or gripping effect achieved by the protruding nature of the blade at angle 14. The gripping effect prevents material from sliding away, and further propagation of the cut is effected by the associated beveled edge 10. Ordinary shears of the prior art which have been provided with an arcuate bevel edged recess for cutting cables and the like, do not provide an angled, doubly beveled cutting juncture in association with the main cutting blade. In the present invention, the critical design of the angled juncture is achieved by causing the beveled edge 10 to proceed at an upward angle toward its tip 11. The angle of the juncture 14 is less than 100°, and preferably between 70° and 90°.

The stube 12 provides the multiple function of (1) protecting the user from accidental injury from the pointed tip 11 during storage and use, (2) permitting insertion of the blade portion 9 under the clothing of a victim to facilitate the cutting away of said clothing without risk of injury to the skin of said victim, and (3) providing an insertable key-like means useful in opening many types of doors when the lock handle assembly is removed therefrom. The stub is preferably an integral part of blade portion 9, and preferably has an essentially square configuration of 0.25 inch measurement.

The pointed tip 11 of blade portion 6 is useful in punching holes in sheet structures and in opening locks having slotted key holes, as found on bathroom doors openable with an emergency key.

The square jaw formed by the bringing together of the handle portions is useful for gripping valve stems as found on compressed air cylinders and valves for controlling fluid flow, and also for opening doors by gripping the square shaft found in most door lock mechanisms underlying the door knob.

The wedge-shaped protrusion 19 is useful as a screwdriver and also in prying-type operations. The pointed extension 20 finds use as a pinch bar useful in opening windows on automobiles. The flat outer edge 18 is useful as a hammer. The deployable key 22 is useful for opening locks on residential interior doors designed to be unlocked with an emergency key. However, other useful implements may be substituted for key 22. The indentation 24 is useful in prying operations and is particularly useful in removing crown closure caps from bottles.

Figure 3:
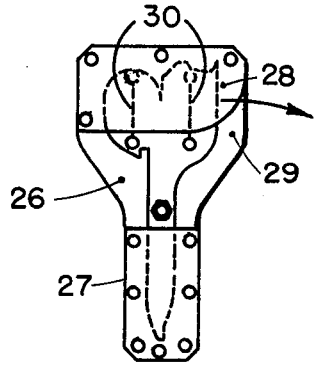
FIG. 3 illustrates a combination tool of FIG. 1 stored in a carrying holster.
Figure 2:
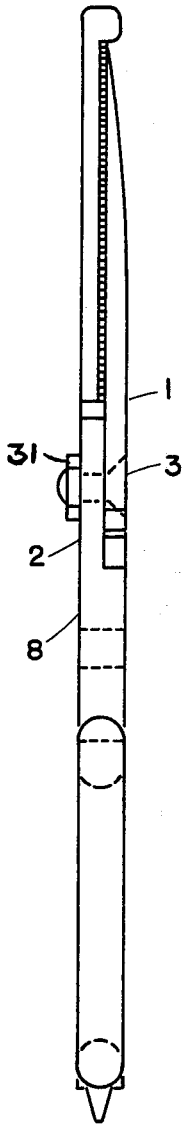
FIG. 2 is a side elevational view of the combination tool of FIG. 1.

The novel shears of this invention are of rugged, durable construction. The generally compact, symmetric design facilitates the carrying of the shears in a belt sheath or holster as shown in FIG. 3 which affords safe storage and quick availability. Because the wedge-shaped protusion 19 and the pointed extension 20 are both located on the finger-accomodating handle portion 4, the combination tool can be withdrawn from holster 26 in a sideways manner, as shown by the arrowed line of FIG. 3. The upper flap 28 and associated pouch 27 of holster 26 provide safe and secure storage of the combination tool. The slots 30 permit mounting of the holster on a belt. Rapid, horizontal deployment of the tool from the holster is facilitated by the open end 29 of the upper flap 28. It is to be emphasized that, only by virtue of its critical design, can the combination tool of this invention possess its several functions and still be safely carried and rapidly deployed in the manner described.

Having thus described my invention, I claim:

1. A compact multifunctional tool useful in rescue operations comprising shears having a first and a second elongated integral member, each comprising a handle portion having eyes to accomodate the fingers of the user, a shank portion and a substantially straight blade portion, said members being pivotably connected in opposed relationship by a threaded bolt in a manner such that said blade portions can be brought into sliding, overlapping contact, the blade portion of said first member being provided with a beveled cutting edge, and tapering to a pointed tip, the blade portion of said second member extending beyond the pointed tip of the blade portion of said first member and terminating with an essentially square stub, an arcuate bevel-edged recess located on the blade portion of said first member between its pointed tip and said bolt, the forward extreme of said recess meeting with said beveled cutting edge at a doubly beveled juncture having an angle of less than 100° and adapted to initiate a cutting action by a puncturing or gripping effect in a sheet structure acted upon by said shears, propagation of said cutting action being achieved by said beveled cutting edge, said bolt being located at a point between 50 and 60 percent of the distance going from the handle end to the stub end of said tool, the overall length of said tool being between about 6 inches and 10 inches, said tool being adapted to operation by a single hand of the user.

2. The tool of claim 1 containing in said shank portions cooperatively opposed notches disposed such that, when said handle portions are brought together said notches align to form a square-apertured jaw.

3. The tool of claim 1 wherein at least one of said handle portions possesses a flat outer surface.

4. The tool of claim 3 wherein at least one of said handle portions contains a wedge-shaped protrusion extending as an integral continuation of said handle portion.

5. The tool of claim 4 wherein at least one of said handle portions contains a pointed extension which constitutes an integral contiuation of said flat outer surface.

6. The tool of claim 5 wherein said wedge-shaped protrusion and said pointed extension are both associated with the same handle portion containing an opening to accomodate the fingers of the user.

7. The tool of claim 1 wherein an inside edge of at least one handle portion contains a recessed compartment which houses a pivotably deployable elongated implement.

8. In a pair of shears comprising two elongated integral substantially flat members, each comprising a handle portion, shank portion and substantially straight blade portion, said members being pivotably connected in coplanar opposed relationship by a threaded bolt in a manner such that said blade portions can be brought into sliding, overlapping contact, at least one of said blade portions being provided with a straight beveled cutting edge, and tapering to a pointed tip, the improvement comprising an arcuate beveledged recess located between said bolt and said pointed tip on said blade portion provided with a straight beveled cutting edge, the forward extreme of said recess meeting with said beveled cutting edge at a doubly beveled juncture having an angle of less than 100° and adapted to initiate a cutting action by a puncturing or gripping effect in a sheet structure acted upon by said shears, propagation of said cutting action being achieved by said straight beveled cutting edge, said shears being adapted to operation by a single hand of the user.

* * * * *